US009674612B2

(12) United States Patent
Wang et al.

(10) Patent No.: US 9,674,612 B2
(45) **Date of Patent: *Jun. 6, 2017**

(54) VIBRATION MEMBER AND SOUND GENERATING DEVICE USING SAME

(71) Applicant: AAC ACOUSTIC TECHNOLOGIES (SHENZHEN) CO., LTD, Shenzhen (CN)

(72) Inventors: Hongxing Wang, Shenzhen (CN); Lubin Mao, Shenzhen (CN)

(73) Assignee: AAC ACOUSTIC TECHNOLOGIES (SHENZHEN) CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 14/979,382

(22) Filed: Dec. 27, 2015

(65) Prior Publication Data

US 2016/0198262 A1 Jul. 7, 2016

(30) Foreign Application Priority Data

Jan. 7, 2015 (CN) ..... 2015 2 0010682 U

(51) Int. Cl.
*H04R 9/06* (2006.01)
*H04R 7/18* (2006.01)

(52) U.S. Cl.
CPC ..... *H04R 7/18* (2013.01); *H04R 9/06* (2013.01); *H04R 2307/207* (2013.01)

(58) Field of Classification Search
CPC ..... H04R 7/18; H04R 9/06; H04R 2307/207
USPC ..... 181/171, 172; 381/396, 398, 403
See application file for complete search history.

(56) References Cited

U.S. PATENT DOCUMENTS

| | | | | |
|---|---|---|---|---|
| 5,739,481 | A * | 4/1998 | Baumhauer, Jr. | H04R 1/025 181/172 |
| 6,607,051 | B1 * | 8/2003 | Peng | H04R 1/16 181/171 |
| 7,318,496 | B2 * | 1/2008 | Sahyoun | H04R 7/20 181/171 |
| 2014/0169614 | A1 * | 6/2014 | Andersen | H04R 7/20 381/398 |
| 2015/0146910 | A1 * | 5/2015 | Beer | H04R 7/00 381/398 |

* cited by examiner

*Primary Examiner* — Brian Ensey
(74) *Attorney, Agent, or Firm* — Na Xu; IPro, PLLC

(57) ABSTRACT

A vibration member is provided in the present disclosure. The vibration member includes a vibration body and a periphery connected with the vibration body, and the periphery includes a first connecting portion, a second connecting portion and a middle connecting portion. The first connecting portion is configured for fixing the vibration body. The second connecting portion is configured for fixing the vibration body. The middle connecting portion is configured for connecting the first connecting portion with the second connecting portion, and the middle connecting portion protrudes in a direction perpendicular to a vibrating direction of the vibration body. A sound generating device using the vibration member also is provided.

7 Claims, 3 Drawing Sheets

VIBRATION MEMBER AND SOUND GENERATING DEVICE USING SAME

FIELD OF THE DISCLOSURE

The present disclosure relates to sound generating devices, and more particularly, to a vibration member and a sound generating device using the vibration member.

BACKGROUND

A related sound generating device such as a speaker includes a periphery, a membrane and a frame. The periphery is a component of a vibration system of the speaker, and is used to connect the membrane with the frame of the speaker.

The periphery is a ring-shaped member having a protrusion that protrudes in a direction perpendicular to the membrane. The protrusion can provide a restoring force to the membrane, and in addition, stiffness of the periphery can be adjusted by adjusting a width and a length of the protrusion, so that a resonant frequency of the vibration system of the speaker is adjustable.

However, the membrane with the aforesaid periphery is difficult to be assembled into the speaker. Moreover, the membrane of the speaker may need to have a relatively large vibrating amplitude in some circumstance, and thus the periphery is inapplicable to the speaker with such large vibrating amplitude requirement.

Accordingly, it is necessary to provide a new vibration member and a sound generating device which can overcome the aforesaid problems.

DETAILED DESCRIPTION

Hereinbelow, the present disclosure will be further described with reference to the attached drawings and embodiments thereof.

Figure 1:
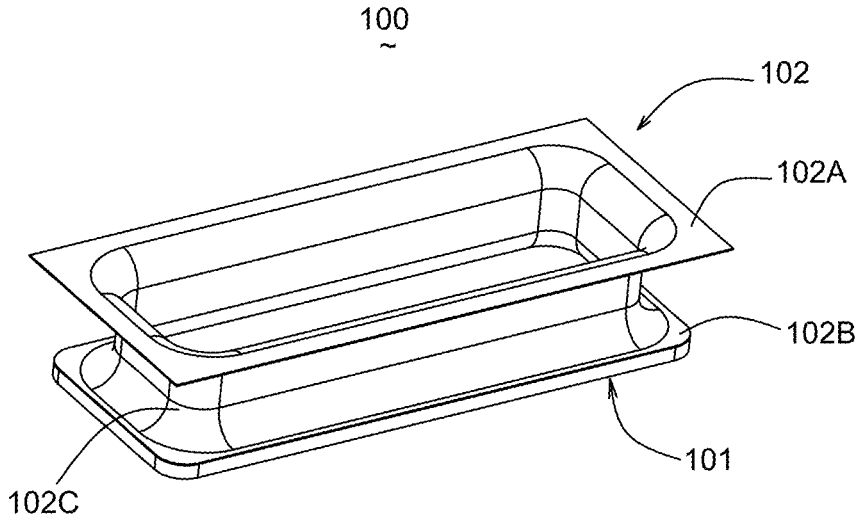
FIG. 1 is a schematic structural view of a vibration member according to a first embodiment of the present disclosure.

FIG. 1 is a schematic structural view of a vibration member according to a first embodiment of the present disclosure. The vibration member 100 is applicable to a sound generating device such as a speaker, and includes a vibration body 101 and a periphery 102. The periphery 102 has a ring-shaped structure. The vibration body 101 may be a vibration sheet or a membrane.

The periphery 102 includes a first connecting portion 102A, a second connecting portion 102B and a middle connecting portion 102C. The first connecting portion 102A is configured for fixing the vibration member 100. The second connecting portion 102B is configured for fixing the vibration body 101, for example, the second connecting portion 102B may be attached to an outer edge of a surface of the vibration body 101. The middle connecting portion 102C is configured for connecting the first connecting portion 102A with the second connecting portion 102B, and the middle connecting portion 102C protrudes in a direction perpendicular to a vibrating direction (e.g., a vertical direction) of the vibration body 101.

The middle connecting portion 102C protruding in the direction perpendicular to the vibrating direction of the vibration body 101 can improve performance of the periphery 102 (e.g., to enable the periphery 102 to withstand a greater vibrating amplitude) without length increasing or width increasing. This facilitates miniaturization and thinning of the sound generating device.

Moreover, in this embodiment, the middle connecting portion 102C protrudes towards a geometric center of the vibration body 101, and in other embodiments, the middle connecting portion 102C may alternatively protrude in a direction away from the geometric center of the vibration body 101.

Figure 2:
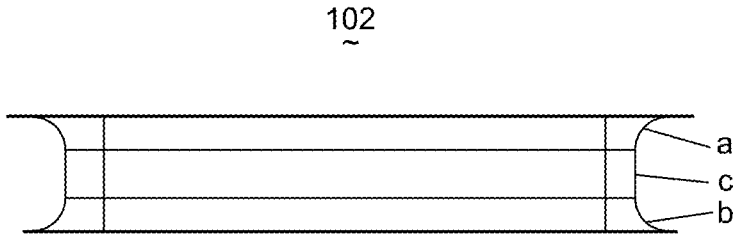
FIG. 2 is a front view of a periphery of the vibration member in FIG. 1.

As shown in FIG. 2, FIG. 2 is a front view of the periphery 102 of the vibration member 100 in FIG. 1. The middle connecting portion 102C includes a first arc surface (labeled with "a"), a second arc surface (labeled with "b") and a middle portion (labeled with "c"). The first arc surface "a" is connected with the first connecting portion 102A. The second arc surface "b" is connected with the second connecting portion 102B. The middle portion "c" is used for connecting the first arc surface "a" with the second arc surface "b". The first arc surface "a" and the second arc surface "b" may have a same curvature radius. In this embodiment, the middle portion "c" is planar surface, and in other embodiments, the middle portion "c" may alternatively be in an arc surface form. For example, when the middle portion "c" is shaped as an arc surface, the curvature radius thereof may be greater than that of the first arc surface "a" and/or the second arc surface "b".

Furthermore, in this embodiment, the first connecting portion 102A and the second connecting portion 102B extend from two opposite ends of the middle connecting portion 102C respectively along a direction parallel to the vibration body 101. In other words, the first connecting portion 102A extends from an end of the first arc surface "a" of the middle connecting portion 102C, while the second connecting portion 102B extends from an end of the second arc surface "b" of the middle connecting portion 102C.

Figure 3:
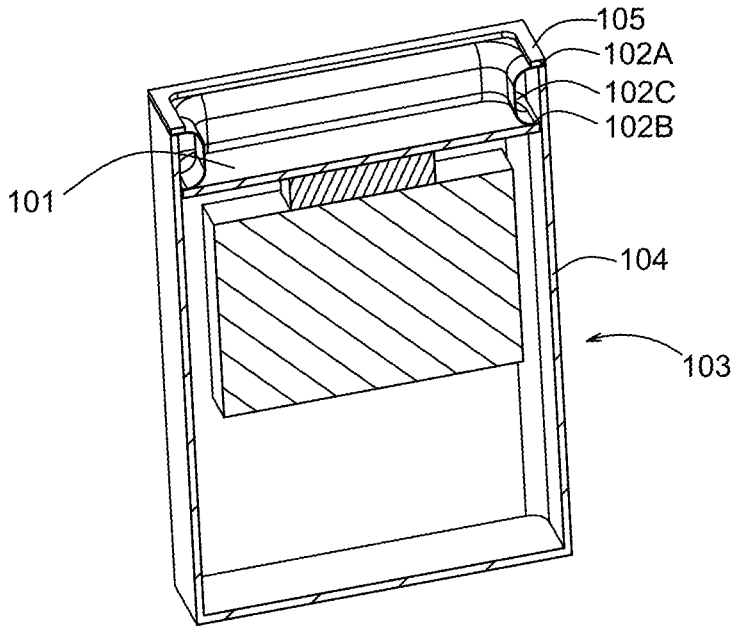
FIG. 3 is a cross-sectional structural view of a sound producing device using the vibration member in FIG. 1.

As a specific application, the vibration member 100 may be applied to a sound generating device as illustrated in FIG. 3, the sound generating device includes a housing 103 and a vibration member illustrated in FIG. 1. The vibration member 100 is disposed inside the housing 103. Specifically, the housing 103 includes a shell 104 with an end surface, and a cover 105 that covers the end surface of the shell 104. For example, the shell 104 may include a plurality of sidewalls connected in an end-to-end manner, and top surfaces of sidewalls cooperatively form the end surface of the shell 104. The first connecting portion 102A of the periphery 102 is disposed between the cover 105 and the end surface of the shell 104, so as to fix the vibration member 100 within the housing 103. Due to the first connecting portion 102A, the vibration member 100 can be easily assembled and fixed into the sound generating device; and moreover, the second connecting portion 102B can facilitate an attachment between the vibration body 101 and the periphery 102.

Figure 4:
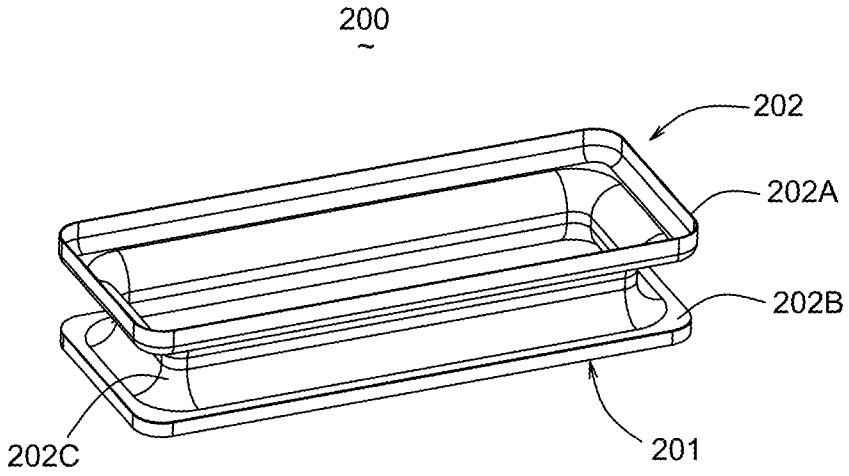
FIG. 4 is a schematic structural view of a vibration member according to a second embodiment of the present disclosure.

FIG. 4 is a schematic structural view of a vibration member according to a second embodiment of the present disclosure. The vibration member 200 includes a vibration body 201 and a periphery 202. The periphery 202 has a ring-shaped structure. The vibration body 201 may be a vibration sheet or a membrane.

The periphery 202 includes a first connecting portion 202A, a second portion 202B and a middle connecting portion 202C. The first connecting portion 202A is configured for fixing the vibration member 100. The second connecting portion 202B is configured for fixing the vibration body 201, for example, the second connecting portion 202B may be attached to an outer edge of a lower surface of the vibration body 201. The middle connecting portion 202C is configured for connecting the first connecting portion 202A with the second connecting portion 202B, and the middle connecting portion 202C protrudes in a direction perpendicular to a vibrating direction (e.g., a vertical direction) of the vibration body 201.

The middle connecting portion 202C protruding in the direction perpendicular to the vibrating direction of the vibration body 201 can improve the performance of the periphery 202 (e.g., to enable the periphery 202 to withstand a greater vibrating amplitude) without length increasing or width increasing. This facilitates miniaturization and thinning of the sound generating devices.

Moreover, in this embodiment, the middle connecting portion 202C protrudes towards a geometric center of the vibration body 201, and in other embodiments, the middle connecting portion 202C may also alternatively protrude in a direction away from the geometric center of the vibration body 201.

The middle connecting portion 202C also includes a first arc surface, a second arc surface and a middle arc surface. The first arc surface is connected with the first connecting portion 202A. The second arc surface is connected with the second connecting portion 202B. The middle connecting arc surface is used for connecting the first arc surface with the second arc surface respectively. The first arc surface and the second arc surface may have a same curvature radius. In this embodiment, the middle connecting arc surface is of an arc surface form having a curvature radius larger than that of the first arc surface and the second arc surface. In other embodiments of the present disclosure, the middle portion may alternatively have planar surface.

Furthermore, in this embodiment, the first connecting portion 202A extends from an end of the middle connecting portion 202C along a direction perpendicular to the vibration body 201, and the second connecting portion 202B extends from the other end of the middle connecting portion 202C in a direction parallel to the vibration body 201. In other words, the first connecting portion 202A extends from an end of the first arc surface of the middle connecting portion 202C, while the second connecting portion 202B extends from another end of the second arc surface of the middle connecting portion 202C.

Figure 5:
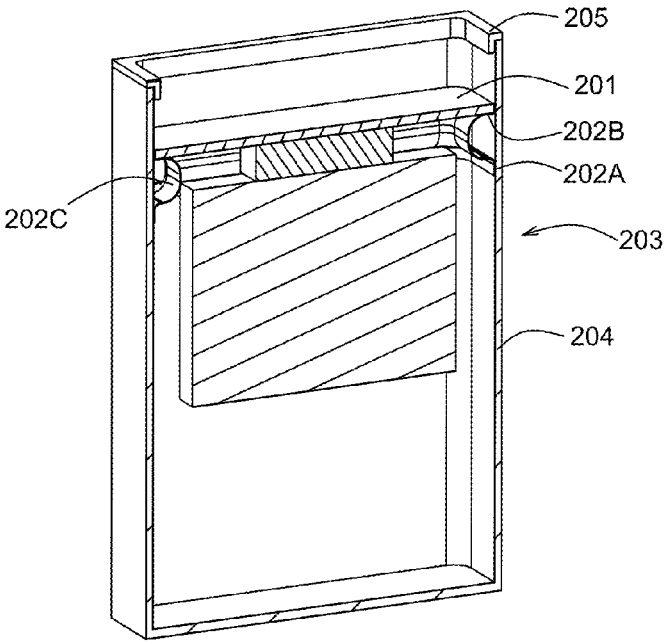
FIG. 5 is a cross-sectional structural view of a sound generating device using the vibration member in FIG. 4.

As a specific application, the vibration member 200 can be applied to a sound generating device as illustrated in FIG. 5, the sound generating device includes a housing 203 and the vibration member 200 disposed inside the housing 203. Specifically, the housing 203 includes a shell 204 with an end surface and a cover 205. The cover 205 covers the end surface of the shell 204. The first connecting portion 202A of the periphery 202 is adhered to an inner sidewall of the shell 204. The adhesion between the second connecting portion 202B and the lower surface of the vibration body 201 will not reduce a radiation area of the vibration body 201. In other words, the entire upper surface of the vibration body 201 participates in the radiation, therefore an overall acoustic performance of the vibration member 200 can be improved.

Figure 6:
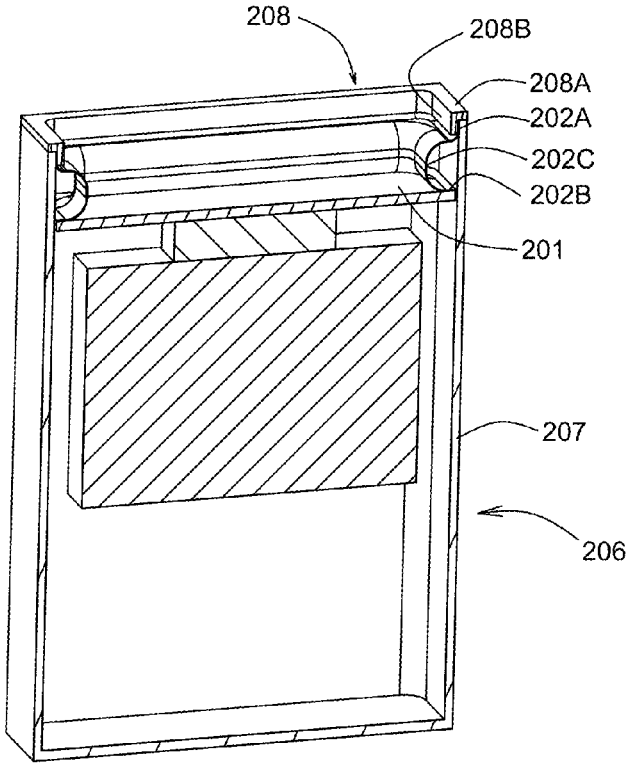
FIG. 6 is a cross-section structural view of another sound generating device using the vibration member in FIG. 4.

As another specific application, the vibration member 200 may be applied to another sound generating devices as illustrated in FIG. 6. The sound generating device also includes a housing 206 and a vibration member 200 illustrated in FIG. 4 disposed inside the housing 206. The housing 206 includes a shell 207 and a cover 208. The shell 207 has an end surface. The cover 208 covers the end surface of the shell 207. The cover 208 includes a body portion 208A and an extending portion 208B. The body portion 208A abuts against the end surface of the cover 208, and the extending portion 208B extends perpendicularly from the vibration body 201. The first connecting portion 202A of the periphery 202 is disposed between the extending portion 208B and an inner sidewall of the shell 207.

What described above are only embodiments of the present disclosure. It shall be noted herein that, modifications may be made by those of ordinary skill in the art without departing from the inventive concepts of the present disclosure, and all these modifications shall be covered within the scope of the present disclosure.

What is claimed is:

1. A vibration member, comprising:

a vibration body having a geometric center; and a periphery connected with the vibration body, wherein the periphery comprises:

a first connecting portion, for fixing the vibration member;

a second connecting portion for fixing the vibration body, and a middle connecting portion for connecting the first connecting portion with the second connecting portion, the middle connecting portion protruding in a direction perpendicular to a vibrating direction of the vibration body, the middle connecting portion protruding close to the geometric center of the vibration body, wherein, the middle connecting portion comprises a first arc surface connected with the first connecting portion, a second arc surface connected with the second connecting portion, a middle portion configured for connecting the first arc surface with the second arc surface, the middle portion has a planar surface or an arc surface having a curvature radius greater than that of the first arc surface and/or the second arc surface.

2. The vibration member of claim 1, wherein the first arc surface has a curvature radius same to that of the second arc surface.

3. The vibration member of claim 1, wherein the vibration body has an upper surface and a lower surface opposite to the upper surface, the second connecting portion is connected with the upper surface or the lower surface.

4. A sound generating device, comprising a housing, and a vibration member disposed in the housing and connected with the housing, the vibration member comprising:

a vibration body having a geometric center; and a periphery connected with the vibration body, wherein the periphery comprises:

a first connecting portion, for fixing the vibration body;

a second connecting portion for fixing the vibration body, and a middle connecting portion for connecting the first connecting portion with the second connecting portion, the middle connecting portion protruding in a direction perpendicular to a vibrating direction of the vibration body, the middle connecting portion protruding close to the geometric center of the vibration body, wherein, the middle connecting portion comprises a first arc surface connected with the first connecting portion, a second arc surface connected with the second connecting portion, a middle portion configured for connecting the first arc surface with the second arc surface, the middle portion has a planar surface or an arc surface having a curvature radius greater than that of the first arc surface and/or the second arc surface.

5. The sound generating device of claim 4, wherein the housing comprises a shell having an end surface, and a cover covering the end surface of the shell, and the first connecting portion of the vibration member is sandwiched between the cover and the end surface of the shell.

6. The sound generating device of claim 4, wherein the housing comprises a shell having an inner sidewall, and the first connecting portion of the vibration member is attached onto the inner sidewall of the housing.

7. The sound generating device of claim 4, wherein the housing comprises an shell having an end surface, and a cover covering the end surface, the cover comprises a body portion abutting against the end surface of the shell and an extended portion extending from the body portion towards the vibration body, wherein the first connecting portion of the vibration member is sandwiched between the extended portion and the inner sidewall of the housing.

* * * * *